US009239198B2

(12) United States Patent
McPhee

(10) Patent No.: US 9,239,198 B2
(45) Date of Patent: Jan. 19, 2016

(54) DEVICES, SYSTEMS, AND METHODS FOR LOADING A MAGAZINE

(71) Applicant: John Robert McPhee, Raeford, NC (US)

(72) Inventor: John Robert McPhee, Raeford, NC (US)

( * ) Notice: Subject to any disclaimer, the term of this patent is extended or adjusted under 35 U.S.C. 154(b) by 0 days.

(21) Appl. No.: 14/215,293

(22) Filed: Mar. 17, 2014

(65) Prior Publication Data

US 2014/0311008 A1 Oct. 23, 2014

Related U.S. Application Data

(60) Provisional application No. 61/788,998, filed on Mar. 15, 2013.

(51) Int. Cl.
*F41A 9/83* (2006.01)
*F41A 9/84* (2006.01)

(52) U.S. Cl.
CPC .... *F41A 9/83* (2013.01); *F41A 9/84* (2013.01)

(58) Field of Classification Search
CPC ..... F41A 9/82; F41A 9/83; F41A 9/84
USPC ..... 3/87; 42/87
See application file for complete search history.

(56) References Cited

U.S. PATENT DOCUMENTS

| | | | | | |
|---|---|---|---|---|---|
| 356,276 | A * | 1/1887 | Diss | 42/88 |
| 447,577 | A * | 3/1891 | Milavanovitch-Koka | 42/88 |
| 578,931 | A * | 3/1897 | Johnson | 42/88 |
| 600,366 | A * | 3/1898 | Johnson | 42/88 |
| 600,367 | A * | 3/1898 | Johnson et al. | 42/88 |
| 2,783,570 | A * | 3/1957 | Kunz | 42/87 |
| 2,834,137 | A * | 5/1958 | Kunz | 42/87 |
| 3,789,531 | A * | 2/1974 | Kersten | 42/87 |
| 4,352,254 | A * | 10/1982 | Peter et al. | 42/88 |
| 4,518,384 | A * | 5/1985 | Tarello et al. | 604/61 |
| 4,538,371 | A * | 9/1985 | Howard | 42/87 |
| 2009/0288326 | A1 * | 11/2009 | Twardy | 42/87 |

* cited by examiner

*Primary Examiner* — Bret Hayes
(74) *Attorney, Agent, or Firm* — Sutherland Asbill & Brennan LLP

(57) ABSTRACT

A magazine loader for loading cartridges into a magazine is provided. The magazine loader may include a base member configured for positioning on an open end of the magazine, a first cartridge support member extending from the base member, and a second cartridge support member extending from the base member. The first cartridge support member may include a first slot configured for receiving a base end of each of the cartridges. The second cartridge support member may include a second slot configured for receiving a tip end of each of the cartridges. A related system for loading and storing cartridges for a firearm also is provided.

20 Claims, 8 Drawing Sheets

DEVICES, SYSTEMS, AND METHODS FOR LOADING A MAGAZINE

CROSS-REFERENCE TO RELATED APPLICATION

This application claims the benefit of U.S. Provisional Application No. 61/788,998, filed on Mar. 15, 2013, which is incorporated by reference herein in its entirety.

FIELD OF THE DISCLOSURE

This disclosure relates generally to devices, systems, and methods for loading a magazine used by a firearm or weapon, and more specifically to a magazine loader for loading the magazine used by the firearm or weapon.

BACKGROUND

The use of magazines in the shooting arts is well known. For example, magazines often are used in conjunction with, or as an integral part of, a repeating firearm for storing and feeding a number of cartridges to be used by the firearm. The magazine functions by sequentially moving the cartridges stored in the magazine into a position where they may be advanced into the chamber by the action of the firearm. In this manner, the magazine allows a user to quickly and easily advance the cartridges for use by the firearm.

Due to challenges in loading the cartridges directly into the magazine by hand, various types of devices, generally referred to as magazine loaders, have been developed. Certain devices may have a complex, multi-part construction for easily loading the magazine. However, the complexity of such devices may result in a high cost and may be unnecessary in many applications. Certain other devices may have a simple, single-part construction but may be difficult or cumbersome to use. For example, such devices may present challenges in positioning the device on the magazine, advancing the cartridges into the magazine, or verifying that the cartridges have been properly loaded into the magazine.

Accordingly, there remains a need for an improved magazine loader having a simple and inexpensive construction while also addressing one or more of the challenges described above.

SUMMARY

This disclosure provides a magazine loader for loading cartridges into a magazine. The magazine loader may include a base member configured for positioning on an open end of the magazine, a first cartridge support member extending from the base member, and a second cartridge support member extending from the base member. The first cartridge support member may include a first slot configured for receiving a base end of each of the cartridges. The second cartridge support member may include a second slot configured for receiving a tip end of each of the cartridges.

This disclosure also provides a system for loading and storing cartridges for a firearm. The system may include a magazine and a magazine loader configured for loading the cartridges into the magazine. The magazine loader may include a base member configured for positioning on an open end of the magazine, a first cartridge support member extending from the base member, and a second cartridge support member extending from the base member. The first cartridge support member may include a first slot configured for receiving a base end of each of the cartridges. The second cartridge support member may include a second slot configured for receiving a tip end of each of the cartridges.

These and other features and improvements of this disclosure will become apparent to one of ordinary skill in the art upon review of the following detailed description when taken in conjunction with the several drawings and the appended claims.

DETAILED DESCRIPTION

Figure 1:
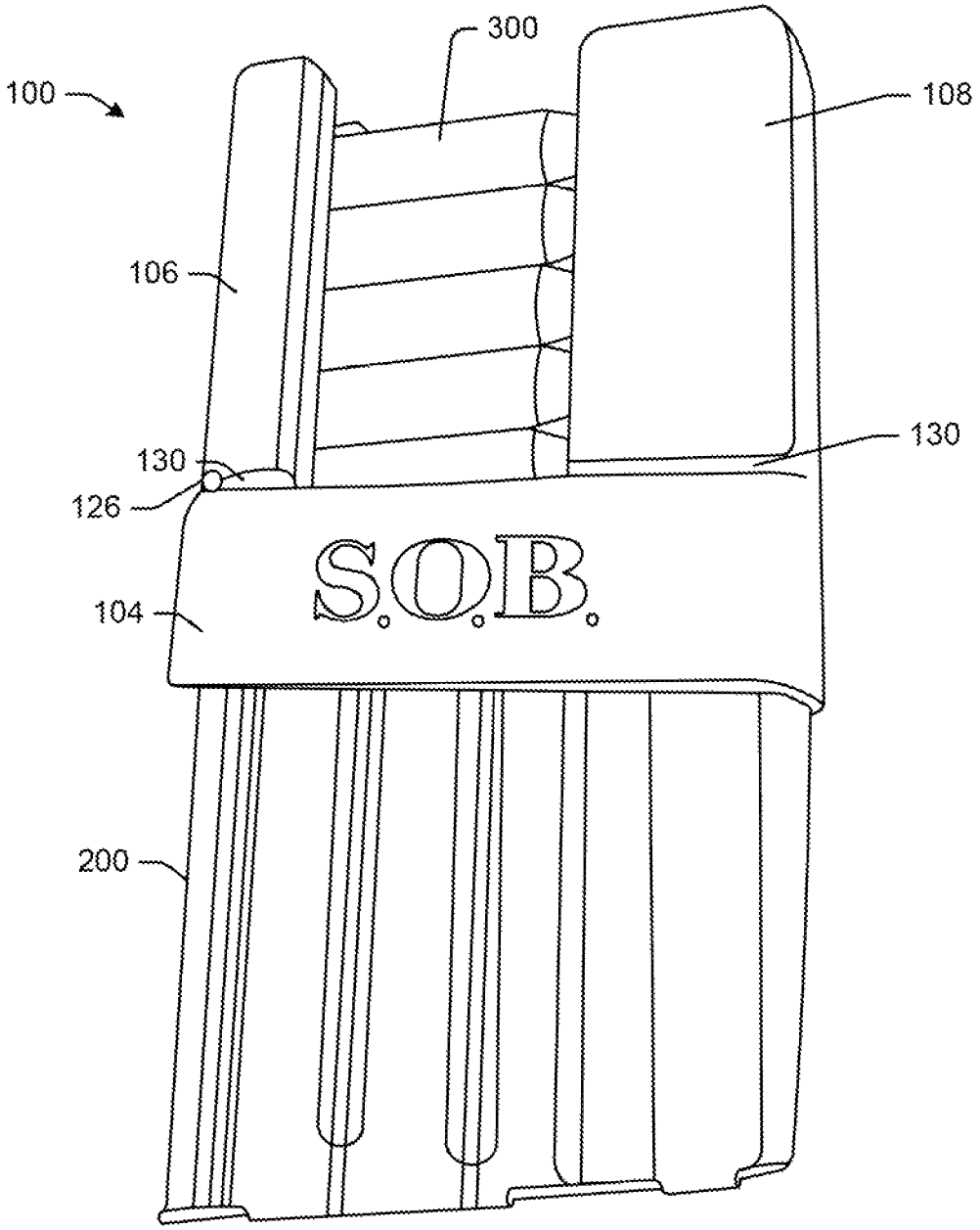
FIG. 1 provides a generally front plan view of an example embodiment of a magazine loader, as may be described herein, positioned on a magazine before loading a number of cartridges.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

This disclosure is directed to a magazine loader that may be used in conjunction with a magazine for a firearm. Specifically, the magazine loader may be positioned on the magazine for loading a number of cartridges into the magazine. In certain aspects, the magazine loader may have a single-part construction; however, the magazine loader may include various features configured for properly positioning the magazine loader on the magazine, securely advancing the cartridges into the magazine, and confidently verifying that the cartridges have been properly loaded into the magazine. In this manner, the magazine loader may allow for quick and easy loading of the magazine, while providing certain advantages over existing devices used in the shooting arts.

Figure 2:
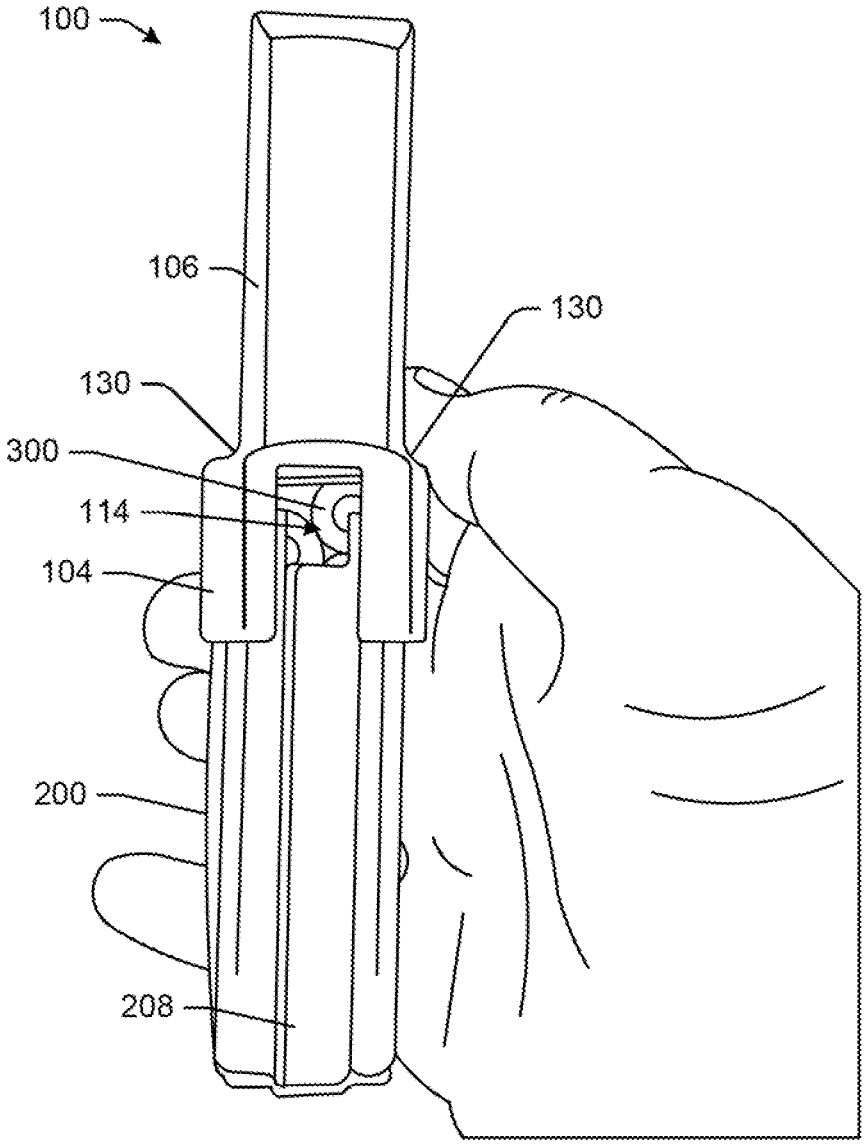
FIG. 2 provides a generally side plan view of the example embodiment of the magazine loader of FIG. 1 positioned on the magazine after loading the number of cartridges and held in a hand of a user.
Figure 3:
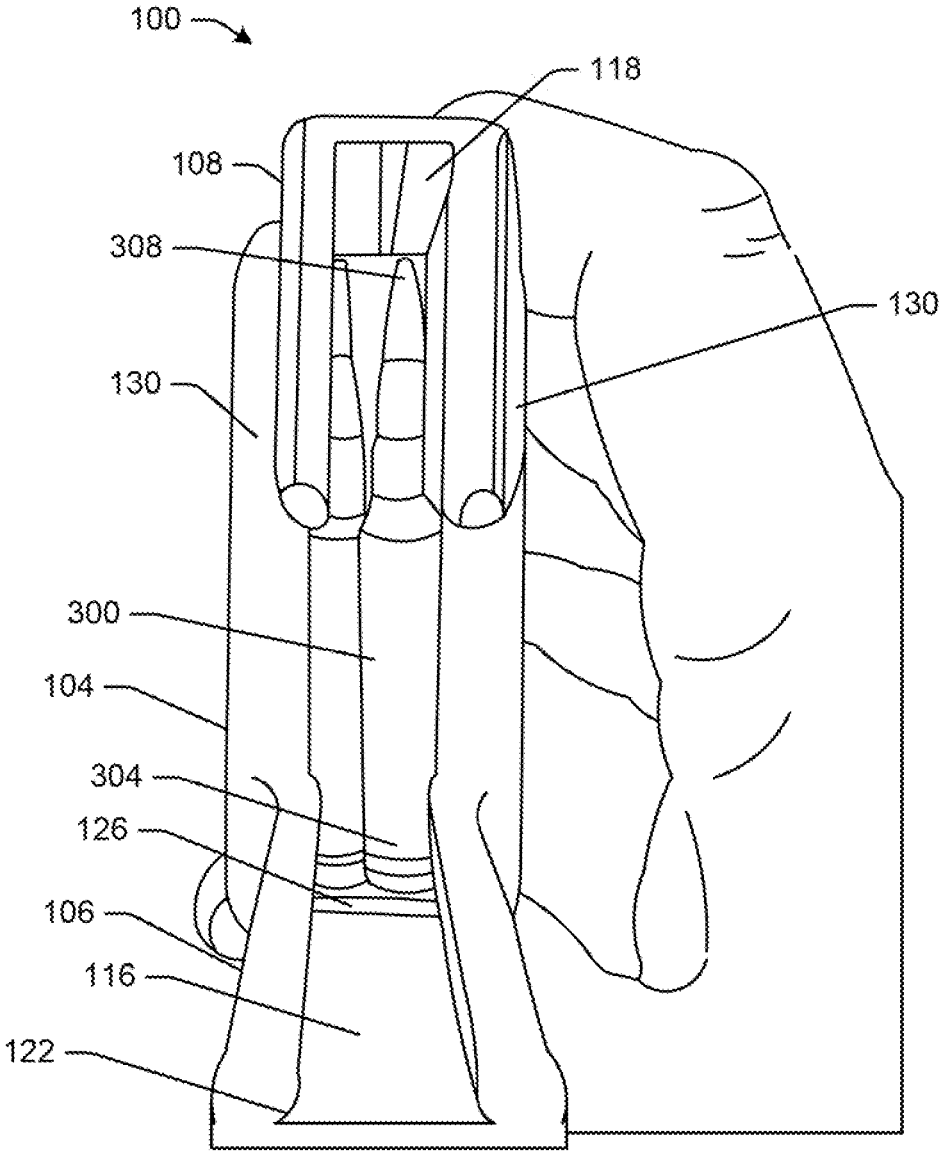
FIG. 3 provides a generally top plan view of the example embodiment of the magazine loader of FIG. 1 positioned on the magazine after loading the number of cartridges and held in the hand of the user.
Figure 4:
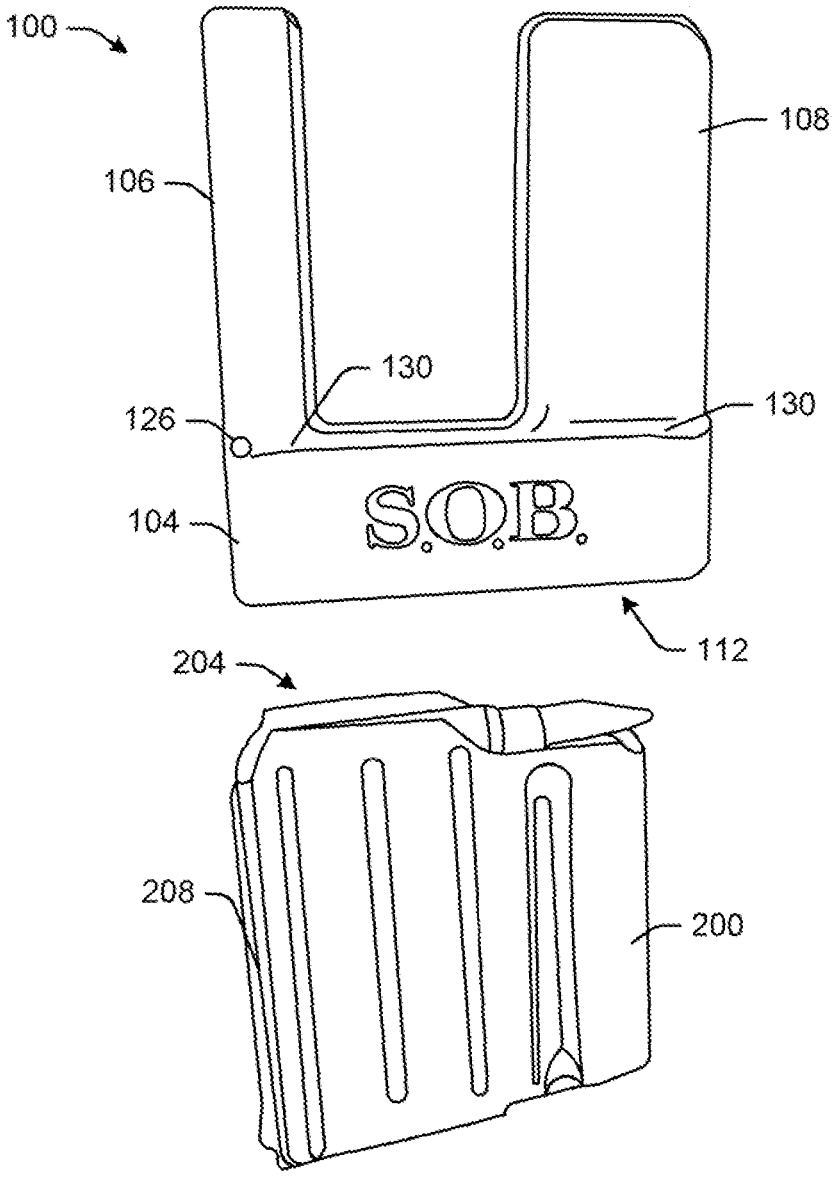
FIG. 4 provides a generally front plan view of the example embodiment of the magazine loader of FIG. 1 separated from the magazine after loading the number of cartridges.
Figure 5:
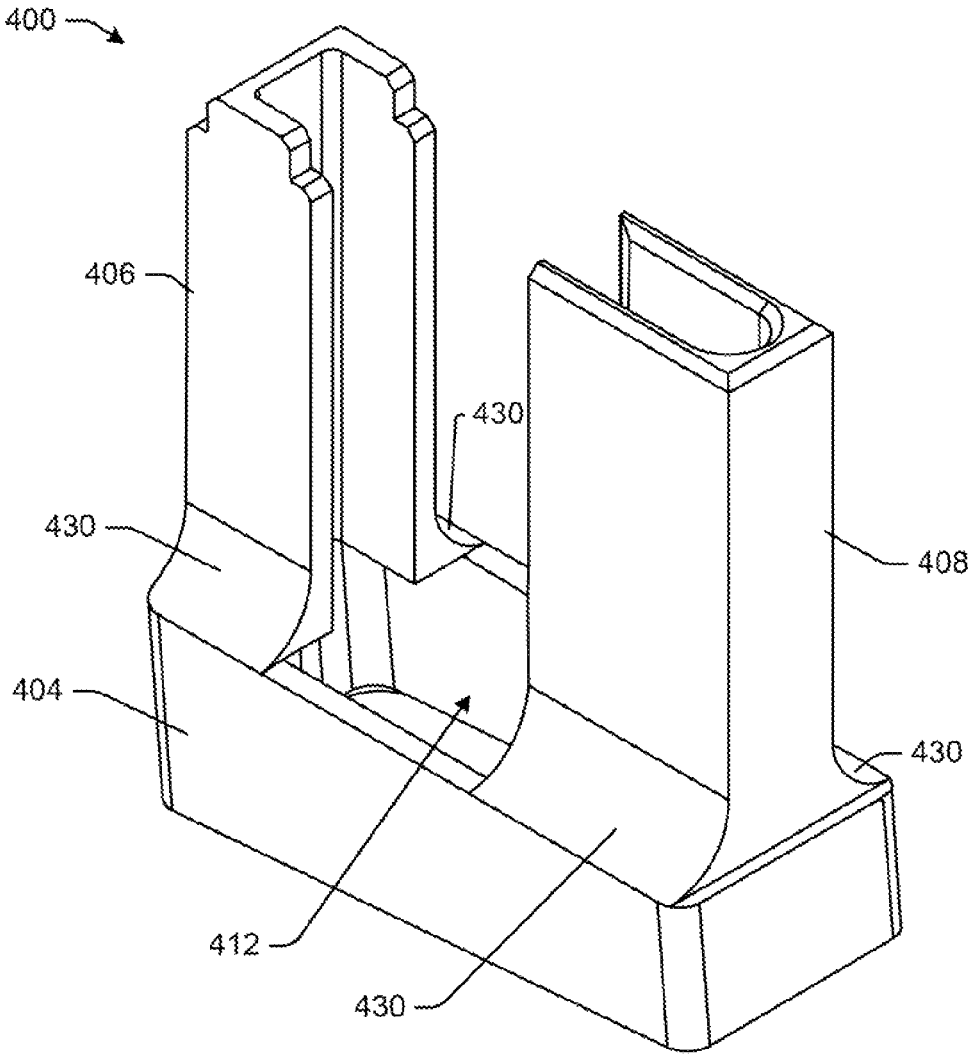
FIG. 5 provides a perspective view of an example embodiment of a magazine loader, as may be described herein.
Figure 6:
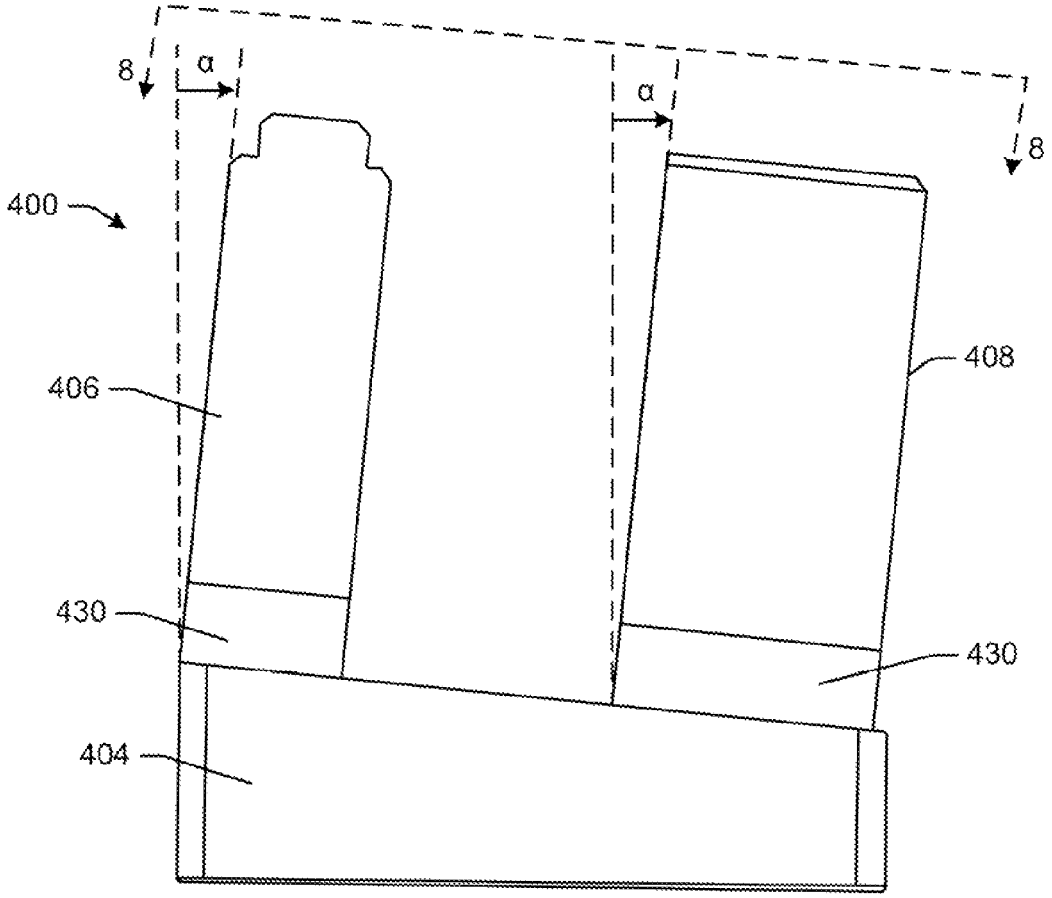
FIG. 6 provides a front plan view of the example embodiment of the magazine loader of FIG. 5.
Figure 7:
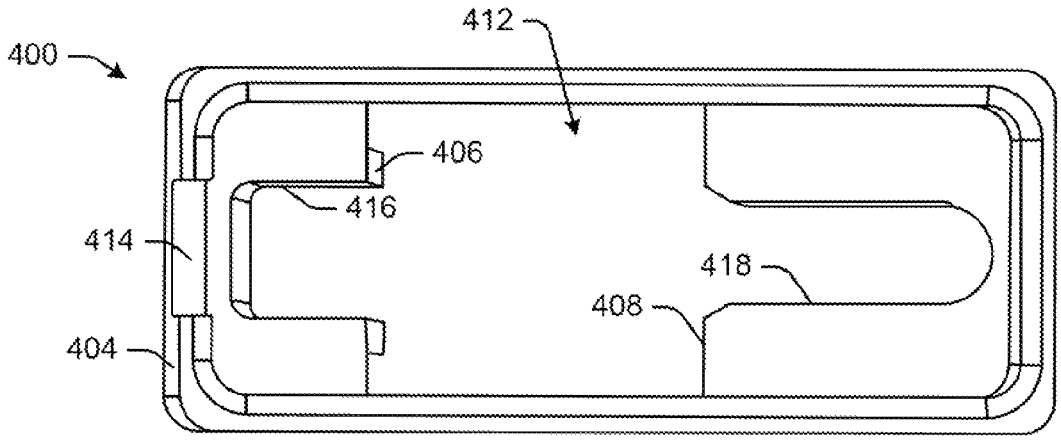
FIG. 7 provides a bottom plan view of the example embodiment of the magazine loader of FIG. 5.
Figure 8:
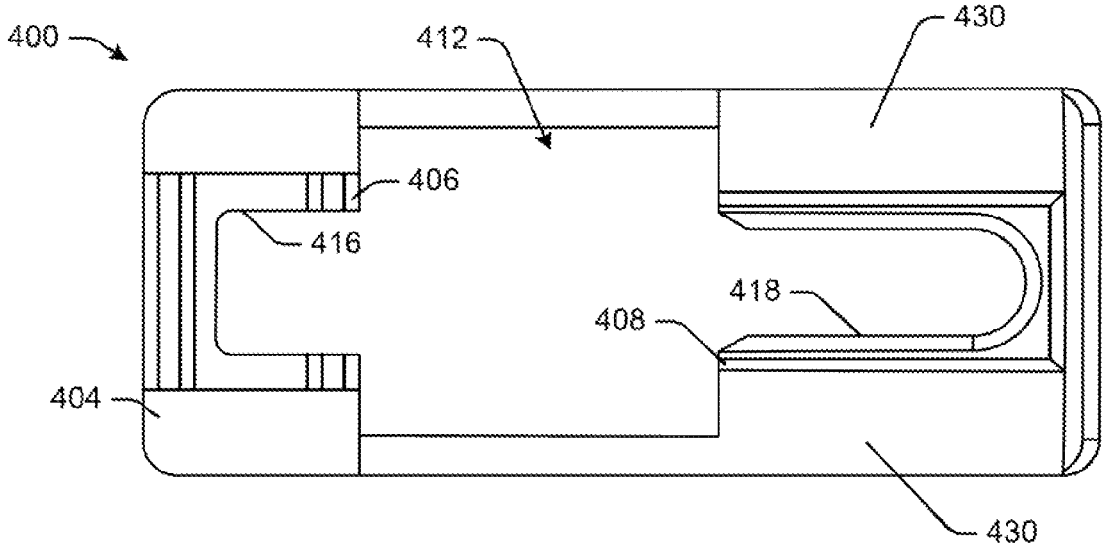
FIG. 8 provides an angled plan view of the example embodiment of the magazine loader of FIG. 5, taken along line 8-8.

FIGS. 1-4 illustrate one example embodiment of a magazine loader 100 configured for positioning on a magazine 200 and advancing a number of cartridges 300 into the magazine 200. The magazine loader 100 may include a base member 104, a first cartridge support member 106, and a second cartridge support member 108. In some aspects, the magazine loader 100 may have a single-part construction such that the base member 104, the first cartridge support member 106, and the second cartridge support member 108 are integrally formed with one another. The base member 104 may be formed as a generally ring-shaped member having a generally rectangular cross-section and defining a generally rectangular aperture 112 therethrough. As is shown, the base member 104 may be configured for positioning on an open end 204 of the magazine 200 such that the open end 204 is received within the aperture 112 of the base member 104. In this manner, the base member 104 may be securely positioned on the magazine 200. In some aspects, the base member 104 may include a cutout 114 defined in a lateral end of the base member 104 and configured for receiving a ridge 208 formed along a lateral end of the magazine 200. In this manner, the base member 104 may accommodate the ridge 208 while providing a secure fit about the perimeter of the magazine 200. Moreover, as is shown in FIG. 2, the cutout 114 may allow a user to verify that cartridges 300 have been properly loaded into the magazine 200.

The first and second cartridge support members 106, 108 may extend from the base member 104, and may be configured for receiving cartridges 300 to be loaded into the magazine 200. As is shown, the first cartridge support member 106 may include a first slot 116 configured for receiving a base end 304 of each of the cartridges 300, and the second cartridge support member 108 may include a second slot 118 configured for receiving a tip end 308 of each of the cartridges 300. In some aspects, the first slot 116 may be configured for receiving a conventional stripper clip (not shown) to which the cartridges may be attached. Specifically, the first slot 116 may include a widened lateral portion 122 configured for receiving the stripper clip. In some such aspects, the magazine loader 100 also may include a roller pin 126 positioned about the interface of the first cartridge support member 106 and the base member 104, and extending partially into the widened lateral portion 122 of the first slot 116. In this manner, the roller pin 126 may prevent the stripper clip from advancing beyond the end of the first slot 116. Accordingly, as the cartridges 300 are advanced through the first slot 116 and into the magazine 200, the stripper clip is retained within the widened lateral portion 122.

In some aspects, the magazine loader 100 also may include transition surfaces 130 extending along the longitudinal interfaces between the first cartridge support member 106 and the base member 104 and between the second cartridge support member 108 and the base member 104. As is shown, the transition surfaces 130 may curve or angle inward from the base member 104 to the first cartridge support member 106 and the second cartridge support member 108. In this manner, the transition surfaces 130 may provide convenient features for a user to grasp with a thumb and finger for positioning and holding the magazine loader 100 on the magazine 200, as is shown in FIG. 2.

The magazine loader 100 may be formed from a variety of materials, including metals, plastics, and composite materials. For example, in some aspects, the magazine loader 100 may be milled from aluminum to provide a lightweight and durable construction. In other aspects, the magazine loader 100 may be molded from a rigid plastic to provide a lightweight and durable construction. In some aspects, the magazine loader 100 may include the roller pin 126 formed as a separate part from a harder material, such as stainless steel. In such aspects, the roller pin 126 may be replaceable, as it may wear over time due to repeated contact with stripper clips. In some aspects, the internal surfaces of the magazine loader 100, particularly the first slot 116 and the second slot 118, may be polished to allow for smooth advancing of the cartridges 300 through the magazine loader 100 and into the magazine 200. Further, in some aspects, a coating or lubricant may be applied to the internal surfaces of the magazine loader 100, particularly the first slot 116 and the second slot 118, to allow for smooth advancing of the cartridges 300 through the magazine loader 100 and into the magazine 200.

FIGS. 5-8 illustrate another example embodiment of a magazine loader 400 configured for positioning on a magazine 200 and advancing a number of cartridges 300 into the magazine 200. The magazine loader 100 may include a base member 404, a first cartridge support member 406, and a second cartridge support member 408. In some aspects, the magazine loader 400 may have a single-part construction such that the base member 404, the first cartridge support member 406, and the second cartridge support member 408 are integrally formed with one another. The base member 404 may be formed as a generally ring-shaped member having a generally rectangular cross-section and defining a generally rectangular aperture 412 therethrough. As is shown, the base member 404 may be configured for positioning on an open end 204 of the magazine 200 such that the open end 204 is received within the aperture 412 of the base member 404. In this manner, the base member 404 may be securely positioned on the magazine 200. In some aspects, the base member 404 may include a cutout 414 defined in a lateral end of the base member 404 and configured for receiving a ridge 208 formed along a lateral end of the magazine 200. In this manner, the base member 404 may accommodate the ridge 208 while providing a secure fit about the perimeter of the magazine 200. Moreover, the cutout 414 may allow a user to verify that cartridges 300 have been properly loaded into the magazine 200.

The first and second cartridge support members 406, 408 may extend from the base member 404, and may be configured for receiving cartridges 300 to be loaded into the magazine 200. As is shown, the first cartridge support member 406 may include a first slot 416 configured for receiving a base end 304 of each of the cartridges 300, and the second cartridge support member 408 may include a second slot 418 configured for receiving a tip end 308 of each of the cartridges 300. In some aspects, as is shown, the first and second cartridge support members 406, 408 each may extend at an acute angle (i.e., not a right angle) relative to a vertical side of the base member 404. For example, in some aspects, the first and second cartridge support members 406, 408 each may extend at an angle $\alpha$ of about 10-degrees to 20-degrees relative to the vertical side of the base member 404. In this manner, the first and second cartridge support members 406, 408 may optimally guide the cartridges 300 into the magazine 200.

In some aspects, the magazine loader 400 also may include transition surfaces 430 extending along the longitudinal interfaces between the first cartridge support member 406 and the base member 404 and between the second cartridge support member 408 and the base member 404. As is shown, the transition surfaces 430 may curve or angle inward from the base member 404 to the first cartridge support member 406 and the second cartridge support member 408. In this manner, the transition surfaces 430 may provide convenient features for a user to grasp with a thumb and finger for positioning and holding the magazine loader 400 on the magazine 200.

The magazine loader 400 may be formed from a variety of materials, including metals, plastics, and composite materials. For example, in some aspects, the magazine loader 400 may be milled from aluminum to provide a lightweight and durable construction. In other aspects, the magazine loader 400 may be molded from a rigid plastic to provide a lightweight and durable construction. In some aspects, the internal surfaces of the magazine loader 400, particularly the first slot 416 and the second slot 418, may be polished to allow for smooth advancing of the cartridges 300 through the magazine loader 400 and into the magazine 200. Further, in some aspects, a coating or lubricant may be applied to the internal surfaces of the magazine loader 400, particularly the first slot 416 and the second slot 418, to allow for smooth advancing of the cartridges 300 through the magazine loader 400 and into the magazine 200.

Many modifications and other embodiments of the invention set forth herein will be apparent having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A magazine loader for loading cartridges into a magazine, comprising:

a base member configured for positioning on an open end of the magazine, the base member comprising a pair of end walls and a pair of side walls defining a rectangular shape;

a first cartridge support member extending from a top surface of the base member, the first cartridge support member comprising a first slot configured for receiving a base end of each of the cartridges; and a second cartridge support member extending from the top surface of the base member, the second cartridge support member comprising a second slot configured for receiving a tip end of each of the cartridges;

wherein the first cartridge support member and the second cartridge support member each extend at an acute angle between 10 degrees and 20 degrees relative to the end walls of the base member; and wherein the first cartridge support member and the second cartridge support member each extend at a perpendicular angle relative to the top surface of the base member.

2. The magazine loader of claim 1, wherein the end walls and the side walls of the base member define an aperture configured for receiving the open end of the magazine, and wherein the first slot and the second slot are in communication with the aperture.

3. The magazine loader of claim 1, wherein the base member further comprises a cutout defined in one of the end walls of the base member and configured for receiving a ridge formed along a lateral end of the magazine.

4. The magazine loader of claim 3, wherein the cutout is further configured for allowing a user to visually verify loading of the cartridges into the magazine.

5. The magazine loader of claim 1, wherein the first slot comprises a widened lateral portion configured for receiving a stripper clip attached to the cartridges.

6. The magazine loader of claim 5, further comprising a roller pin extending partially into the widened lateral portion of the first slot and configured for preventing the stripper clip from advancing beyond an end of the first slot.

7. The magazine loader of claim 1, further comprising transition surfaces extending along interfaces between the first cartridge support member and the base member and between the second cartridge support member and the base member, wherein the transition surfaces are configured for being grasped by a user to position the magazine loader on the magazine.

8. The magazine loader of claim 7, wherein the transition surfaces angle inward from the base member to the respective cartridge support member.

9. The magazine loader of claim 1, wherein the end walls of the base member have different heights.

10. The magazine loader of claim 1, wherein the end walls of the base member extend at a perpendicular angle relative to a bottom surface of the base member.

11. The magazine loader of claim 1, wherein the base member, the first cartridge support member, and the second cartridge support member are integrally formed with one another.

12. The magazine loader of claim 1, wherein magazine loader is formed from aluminum.

13. The magazine loader of claim 1, wherein magazine loader is formed from plastic.

14. The magazine loader of claim 1, wherein the first slot and the second slot are polished.

15. The magazine loader of claim 1, further comprising a coating or a lubricant applied to the first slot and the second slot.

16. The magazine loader of claim 1, wherein the first slot extends from a fixed end of the first cartridge support member adjacent the base member to a free end of the first cartridge support member, and wherein the second slot extends from a fixed end of the second cartridge support member adjacent the base member to a free end of the second cartridge support member.

17. A system for loading and storing cartridges for a firearm, comprising:

a magazine comprising an open end; and a magazine loader configured for loading the cartridges into the magazine, the magazine loader comprising:

a base member configured for positioning on the open end of the magazine, the base member comprising a pair of end walls and a pair of side walls defining a rectangular shape;

a first cartridge support member extending from a top surface of the base member, the first cartridge support member comprising a first slot configured for receiving a base end of each of the cartridges; and a second cartridge support member extending from the top surface of the base member, the second cartridge support member comprising a second slot configured for receiving a tip end of each of the cartridges wherein the first cartridge support member and the second cartridge support member each extend at an acute angle between 10 degrees and 20 degrees relative to the end walls of the base member; and wherein the first cartridge support member and the second cartridge support member each extend at a perpendicular angle relative to the top surface of the base member.

18. The system of claim 17, wherein the base member comprises a cutout defined in one of the end walls of the base member and configured for receiving a ridge formed along a lateral end of the magazine and for allowing a user to visually verify loading of the cartridges into the magazine.

19. The system of claim 17, wherein the first slot comprises a widened lateral portion configured for receiving a stripper clip attached to the cartridges, and wherein the magazine loader further comprises a roller pin extending partially into the widened lateral portion of the first slot and configured for preventing the stripper clip from advancing beyond an end of the first slot.

20. The system of claim 17, wherein the end walls of the base member have different heights, and wherein the end walls of the base member extend at a perpendicular angle relative to a bottom surface of the base member.

* * * * *